United States Patent [19]

Scharnell, Jr. et al.

[11] Patent Number: 4,596,495

[45] Date of Patent: Jun. 24, 1986

[54] SPUD BUSHING SYSTEM FOR MOBILE OFFSHORE ARCTIC DRILLING STRUCTURE

[75] Inventors: Robert A. Scharnell, Jr., Clayton, Calif.; Robert F. Mast, Auburn, Wash.

[73] Assignee: Standard Oil Company, Ohio

[21] Appl. No.: 704,558

[22] Filed: Feb. 22, 1985

[51] Int. Cl.[4] ..... E02B 17/02

[52] U.S. Cl. ..... 405/227; 405/217

[58] Field of Search ..... 405/195, 217, 224, 227, 405/228, 229; 166/339, 340, 365; 285/18

[56] References Cited

U.S. PATENT DOCUMENTS

| | | | |
|---|---|---|---|
| 3,645,565 | 2/1972 | Houot et al. | 285/18 |
| 3,675,713 | 7/1972 | Watkins | 166/340 |
| 4,167,279 | 9/1979 | Lucksinger | 405/227 X |
| 4,497,592 | 2/1985 | Lawson | 405/227 X |
| 4,497,594 | 2/1985 | Fern | 405/217 |

*Primary Examiner*—David H. Corbin

*Attorney, Agent, or Firm*—D. J. Untener; L. W. Evans

[57] ABSTRACT

A spud bushing system for a mobile offshore arctic drilling structure that permits removal of a spud bushing in a controllable manner even under load. The spud bushing system is characterized by a bushing seat fixed in the structure, an annular bushing surrounding the spud and operative when seated in the bushing seat to support laterally the spud while permitting relative vertical movement therebetween, and plural hydraulic actuators arranged about the periphery of the bushing seat and operable to effect seating and controlled unseating of the bushing.

24 Claims, 11 Drawing Figures

SPUD BUSHING SYSTEM FOR MOBILE OFFSHORE ARCTIC DRILLING STRUCTURE

The invention herein disclosed relates generally to a spud bushing system having application in a mobile offshore structure and particular application in a mobile platform structure used in arctic waters where the dominant environmental loading threats are posed by winter ice pressures and summer ice flow impacts.

BACKGROUND

In copending U.S. patent application Ser. No. 489,757, filed Apr. 29, 1983 and entitled "Mobile Offshore Drilling Structure for the Arctic", there is disclosed a mobile platform structure having particular application to exploratory drilling for oil and gas in the substratum underlying offshore acrtic waters and ice formations. The mobile platform structure includes an ice load bearing, submergible substructure and a platform superstructure of approximately equal lateral dimensions, the latter being supported on the substructure and above sea level when the substructure is ballasted onto the sea floor. The substructure has a height approximately equal the desired depth of submergence and includes horizontal top and bottom walls, a substantially vertical, peripheral side wall surrounding the top and bottom walls, and a plurality of vertical bulkheads extending between the top and bottom walls to form a plurality of ballast compartments.

The mobile platform structure of such copending application incorporates large diameter spuds to provide a large proportion of the structure's lateral resistance to global lateral ice loads. The spuds are relatively long and extend vertically through vertical spud guides including spud sleeves interposed between the vertical bulkheads and connected top and bottom to the top and bottom walls of the substructure. The spuds consist of large diameter steel cylinders which are reactively supported by bushings at the top and base of the substructure for lateral load transfer to the top and bottom walls of the substructure.

During the application of global lateral ice loads, the structure will displace until equilibrium is achieved between such loads and the resisting forces from the mobilization of the foundation soils by the mat (base of the substructure) and the spuds. The spuds may elastically yield in bending until such equilibrium is established. Also, the spud bushings will permit relative vertical movement between the spuds and the structure so that the structure can maintain contact with the soil during any consolidation settlements and tilt slightly as necessary to develop bearing resistance to overturning moments without overloading the structure locally at spud support points.

Upon redeployment of the mobile platform structure to another installation site, there could remain a substantial residual load in a spud even though the structure then is free of external ice loads. Although the bushings disclosed in the aforesaid application could be removed from their mounts, as by jacking, to relieve a residual load, such would have been difficult and time consuming to avoid possibe damage to the structure or harm to personnel. Analyses of the spuds have indicated that the bushing loads could be very high for a fully loaded spud. Displaced spud profiles indicate that, for a fully elastic spud, the spud head may "kick back" laterally if the upper bushing, that at the top wall of the substructure, is removed under full or substantial residual load.

Accordingly, it is important to provide a spud bushing system which avoids damage to the structure and personnel while permitting quick and efficient removal of the bushing for alleviating high residual loads in the spuds.

SUMMARY OF THE INVENTION

The present invention provides an improved spud bushing system which permits removal of the bushing in a controllable manner even under load. With this system, the bushing can be removed safely, quickly and efficiently, thereby decreasing the potentially expensive demobilization costs due to a loss in the platform's operation time.

In accordance with the invention, the spud bushing system comprises a bushing seat fixed in the structure, a bushing operative when seated in the bushing seat to support laterally a spud while permitting relative movement therebetween, and means interengageable between the structure and the bushing for effecting controlled removal of the bushing from the bushing seat when the spud is laterally loaded against the bushing.

According to another aspect of the invention, a spud bushing system in a mobile offshore structure comprises a bushing seat fixed in the structure, a bushing operative when seated in the bushing seat to support laterally a spud while permitting relative movement therebetween, and a bushing operator interconnected between the structure and the bushing for seating and unseating the bushing in the bushing seat.

More particularly, the bushing and bushing seat have correspondingly tapered seating surfaces, and controlled removal (unseating) of the bushing is effected by plural hydraulic piston-cylinder assemblies arranged about the periphery of the bushing seat and connected between the bushing and the structure. To remove the bushing when subjected to lateral load, the pressure in the piston-cylinder assemblies may be controllably relieved (bled) to permit vertical unseating movement of the bushing. This gradual unseating of the bushing permits progressively greater lateral movement of the spud thereby to release elastic energy stored in the spud under the control of the piston-cylinder assemblies. As is preferred, the bushing and bushing seat are fabricated constructions having multi-faceted seating surfaces, and the piston-cylinder assemblies each are anchored at one end to supports fixed to the bushing seat.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
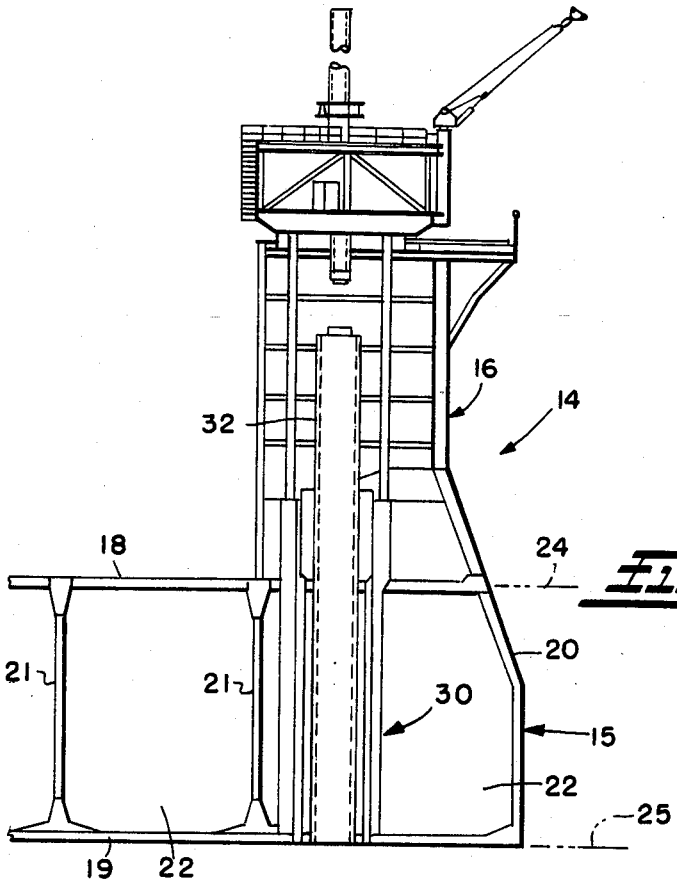
FIG. 1 is a partial schematic vertical sectional view through a mobile arctic drilling structure, there being illustrated the general relationship between the structure and a spud guide embodying a spud bushing system according to the invention.

Referring now in detail to the drawings and initially to FIG. 1, a mobile drilling structure intended for installation in arctic offshore waters is partly shown in section at 14. The structure 14 includes, as a major component, a prestressed and reinforced concrete substructure or base 15 and a concrete and steel superstructure 16 supported on the substructure 15. For particular details of the structure 14 in general, reference may be had to the above mentioned U.S. patent application Ser. No. 489,757 which is hereby fully incorporated herein by reference as a preferred environment for the spud bushing system of the subject invention. The spud bushing system of the subject invention, however, may have application in other types of mobile offshore structures as will be appreciated upon an understanding of the following detailed description.

For purposes of the following description, it is noted that the substructure 15 includes horizontal top and bottom diaphragms or walls 18 and 19, respectively, and a generally upright side wall 20 surrounding the top and bottom walls 18 and 19. Also included in the substructure are a plurality of vertical bulkheads 21 which extend between the top and bottom walls 20 and 21 and form therewith a plurality of ballast compartments 22.

The top wall 18 preferably is located at about mean sea level height, indicated at 24, for the intended installation site of the structure 14 when the substructive 15 is submerged onto the sea floor, indicated at 25. For example, the structure may be used in mean water depth on the order of about 50 ft. whereby the top wall accordingly is located at about the 50 ft. structure elevation.

The substructure 15 also is provided with a plurality of vertical spud guides 30 which are interposed between the bulkheads 21 and connected top and bottom to the top and bottom walls 18 and 19, respectively. Although only one such spud guide is seen at 30 in FIG. 1, the spud guides may number more than forty and are arranged along the periphery of the substructure. Each spud guide 30 preferably is sealed to the top and bottom walls 18 and 19 to preserve watertightness of the respective ballast compartment 22 through which spud guide passes.

The spud guide 30 is sized to receive a spud 32 which is adapted to be embedded at its lower end in the sea floor substrate. The spud preferably is a large diameter, thick walled (1½" to 4") steel cylinder having a yield point of about 50,000 psi and a length exceeding the height of the spud guide by its intended maximum depth of penetration into the sea floor. For example, the spud may be about 7 ft. in diameter and have a length on the order of 110 ft. whereas the spud guide may have a height of about 65 ft. thus allowing for spud penetration on the order of about 40 ft. with about 5 ft. of the spud extending above the spud guide. To accommodate anticipated impact loadings from summer ice flows, relatively ductile steel is employed, such having the carbon content preferably limited to 0.12%, the carbon equivalent to 0.45%, and a transverse Charpy impact value of about 15 ft/lbs at −5° C. The spud desirably is epoxy coated in the upper portion and cathodically protected by sacrificial anodes in the lower portion. The tip of the spud also may be reinforced by steel rings in order to prevent local damage to the tip during installation.

Figure 2:
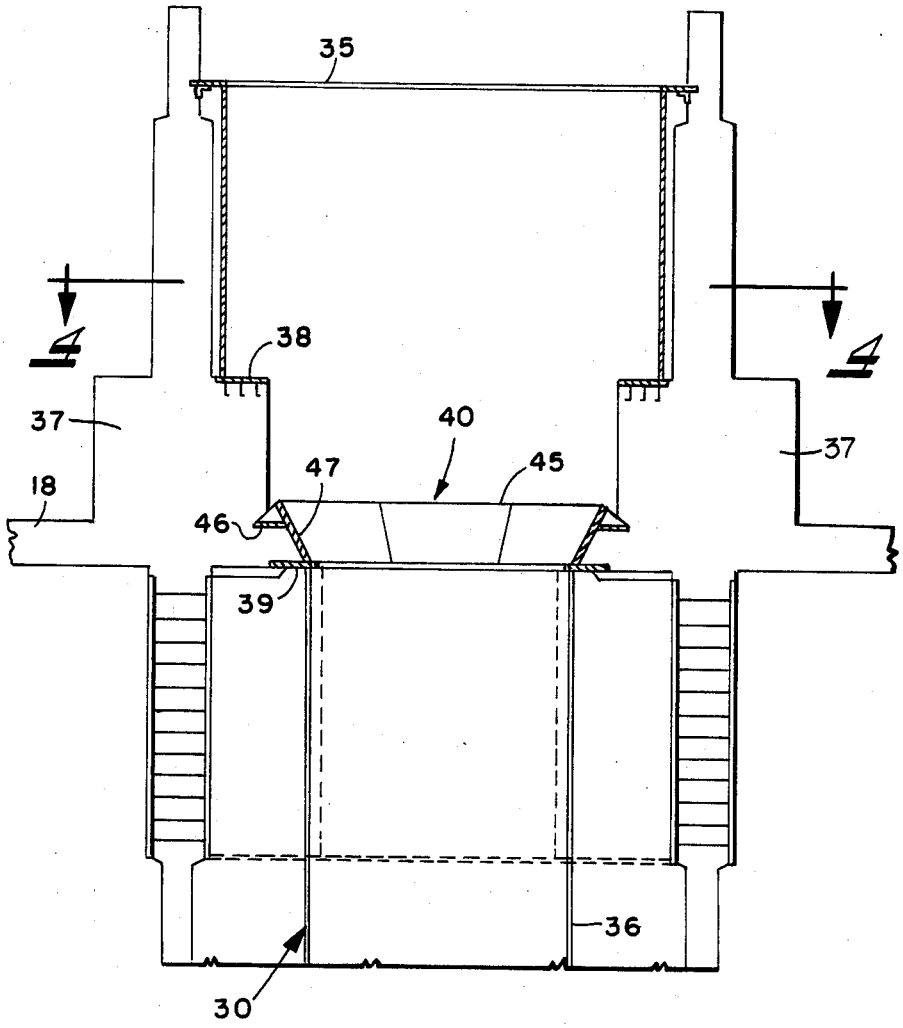
FIG. 2 is an enlarged partial diametric sectional view through the upper portion of the spud guide of FIG. 1, there being shown the upper bushing seat of the spud bushing system.
Figure 3:
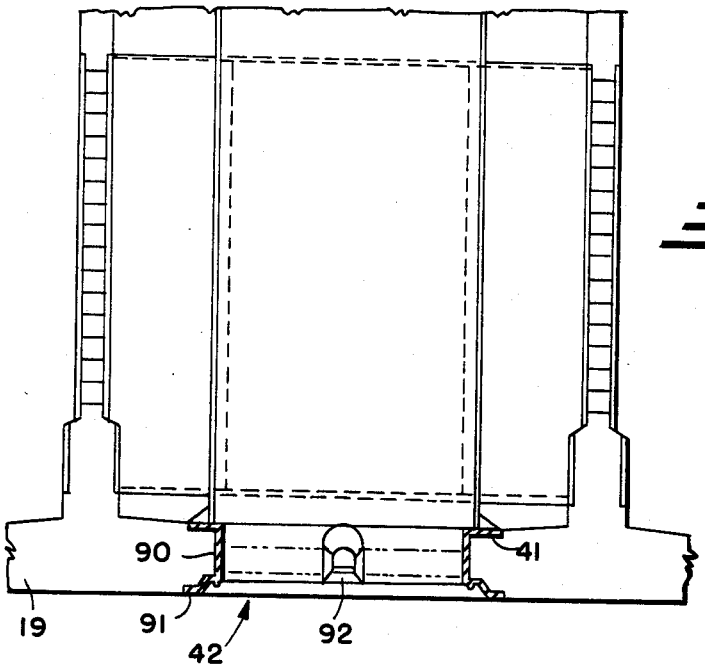
FIG. 3 is an enlarged partial diametric sectional view through the lower portion of the spud guide of FIG. 1, there being shown, in particular, a bottom bushing.

Referring now to FIGS. 2 and 3, the spud guide 30 can be seen to include upper and lower steel cylinders or sleeves 35 and 36 which have inner diameters greater than the outer diameter of the spud 32. The upper sleeve 35 at its lower end has diametrically opposed chordal recesses for interfit between adjacent concrete beams 37 formed integrally with and atop the top wall 18 as shown. The top of each recess is closed by a seal plate 38 anchored atop the inner ledge or shoulder of the respective concrete beam. The lower sleeve 36 at its top end is welded to the bottom horizontal annular plate 39 of an upper bushing bearing seat 40 and at its bottom end to the top annular flange 41 of a bottom bushing 42. The upper bushing seat 40 and bottom bushing 42 are cast integrally in the top and bottom walls 18 and 19, respectively, for lateral load transfer from the spuds to the top and bottom walls at respective fulcrum points.

Figure 4:
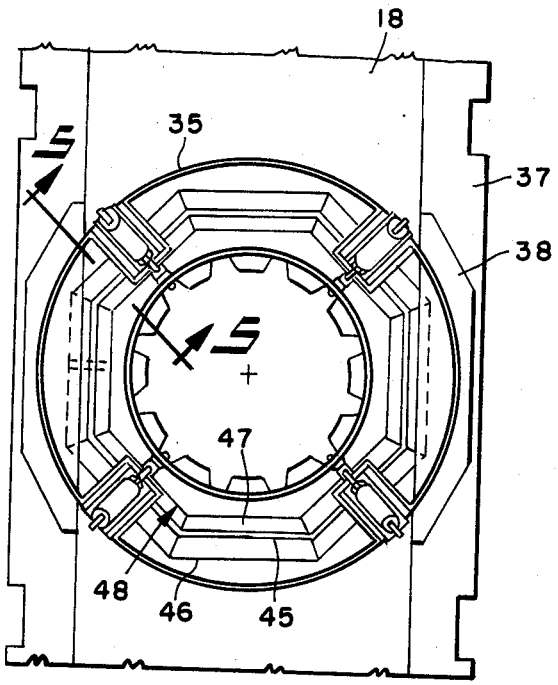
FIG. 4 is a horizontal sectional view of the spud guide taken substantially along the line 4—4 of FIG. 2, but with the upper bushing and related components included for illustration.
Figure 5:
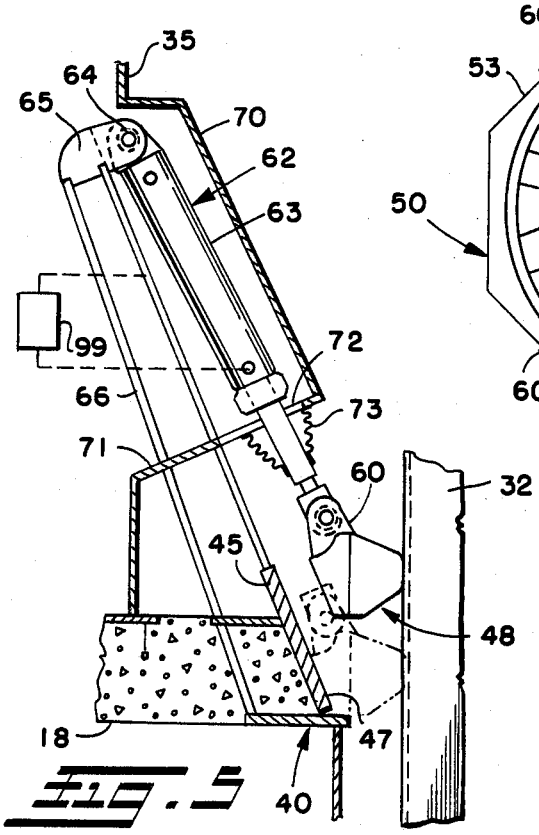
FIG. 5 is an enlarged partial vertical sectional view through the upper bushing/seat assembly taken substantially along the line 5—5 of FIG. 4.

As seen in FIGS. 2, 4, and 5, the upper bushing seat 40 may be an annular fabricated metal construction including the bottom flange plate 39, a multi-faceted bearing wall 45 and a top horizontal flange plate 46. In the illustrated embodiment, the bearing wall 45 is octagonal in shape having eight flat sides or facets 47 inclined upwardly to form a tapered seat for an upper bushing 48. As shown, the parallel bottom and top flange plates 39 and 46 extend radially outwardly of the bearing wall 45 and are spaced apart by about the thickness of the top wall 18 for anchoring of the bushing seat in the top wall as illustrated. The bottom flange plate 39 also may extend radially inwardly of the bearing wall to provide a positive bottom stop for the upper bushing 48 if desired. As best illustrated in FIG. 4, the top and bottom flange plates may be fabricated from a plurality of trapezoidal shape plates which are annularly arranged and welded together at adjacent butted edges.

Figure 6:
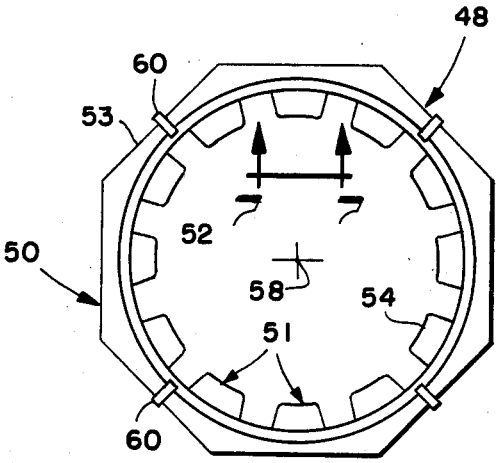
FIG. 6 is a top plan view of the upper bushing.
Figure 7:
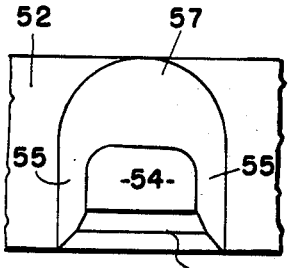
FIG. 7 is a partial plan view of the upper bushing of FIG. 6 as viewed from the line 7—7 thereof.

With additional reference to FIG. 6, the upper bushing 48 has an annular bearing ring 50 and a plurality of radially inwardly extending bushing teeth 51. The ring 50 has a cylindrical inner diameter surface 52 and an octagonal shape, tapered outer diameter surface 53 corresponding in diameter and taper to the lower end portion of the bearing wall 45 in which the upper bushing seats and is lodged against horizontal (radial) movement relative to the top wall 18. The teeth 51 project inwardly from the inner diameter surface 52 of the bearing ring 50 at circumferentially equally spaced locations and may number twelve as shown. As seen in FIGS. 6 and 7, each tooth 51 has a radially inner face 54, tapered side faces 55, a bottom face 56 and a convex upper face 57 which tapers to the front face 54 as shown. The front faces 54 may be curved with the arcs thereof struck from the center axis 58 of the bushing. The inner faces 54 accordingly define an imaginary cylinder concentric with the bushing. Preferably such cylinder has a diameter slightly greater than the outer diameter of the spud 32 to provide clearance for facilitating insertion and removal of the spud as well as limited radial movement of the spud in the bushing when the spud is placed under load. Preferably the diameter of the imaginary cylinder exceeds the outer diameter of the spud by about two inches for a spud having an outer diameter on the order of 7 ft.

For controlled seating and unseating of the upper bushing 48 with respect to the bushing seat 40, the bearing ring 50 of the bushing is provided with upwardly extending pad eyes 60 to which the rods 61 of respective double-acting hydraulic piston-cylinder assemblies 62 are pivotally connected as seen in FIG. 5. The cylinder 68 of each assembly 62 is in turn pivotally connected, as by spherical bearings 64, at their blind end to inwardly protruding bracket 65 fixed to the top of a cylinder support arm 66. The support arm 66 is in the form of a tapered I-beam integrally joined at its lower end to the bushing seat 40. The support arm 66 preferably extends from the bushing seat at the same angle or incline of the bushing seat facets 47. In the illustrated embodiment, four piston-cylinder assemblies 62 are provided and centered to respective alternating facets 47 of the bushing seat.

The upper spud sleeve 35 is provided with an inwardly protruding pocket 70 for each piston-cylinder assembly 62. The slightly upwardly inclined bottom wall 71 of the pocket has a hole 72 through which the rod 61 of the piston-cylinder assembly extends. Preferably such hole 72 is closed about the rod by a rubber boot 73 or the like which forms a watertight seal. Also, the hole is of a size to accommodate swinging movement of the piston-cylinder assembly during seating and unseating of the bushing 48 in the below discussed manner.

The upper bushing 48 is seated in the bushing seat 40 by extending the piston-cylinder assemblies 62. Accordingly, the assemblies 62 will drive the bushing 48 downwardly into full seated engagement in the bushing seat so as to lock laterally the bushing in the top wall 18 of the substructure 15 for lateral load transfer therebetween. As is desired, a mechanical locking device of suitable type may be employed to hold the bushing seated in the bushing seat against vertical force components of encountered loads that would cause the bushing to lift out of the bushing seat. By employing a mechanical locking device, the piston-cylinder assemblies 62 need not be maintained pressurized in their extend mode between the bushing seating and unseating operations which may be spaced many months apart. Also, a portable hydraulic pressure source and control module may be used to accomplish the seating (or unseating) of the upper bushing associated with each spud in the structure.

Figure 8:
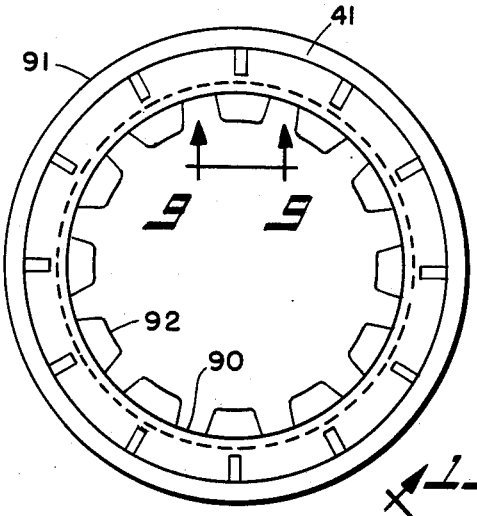
FIG. 8 is a top plan view of the bottom bushing.
Figure 9:
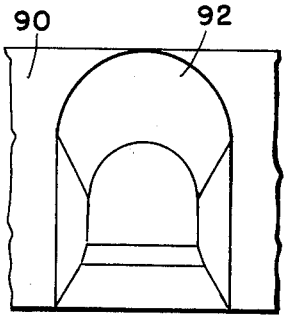
FIG. 9 is a partial plan view of the bottom bushing of FIG. 8 as viewed from the line 9—9 thereof.

After the upper bushing 48 has been seated as seen in broken lines in FIG. 5, installation of a spud 32 may be effected with the seated bushing serving to guide the spud as it is driven downwardly into the sea floor foundation as by a vibratory hammer in the manner more fully set forth in the above mentioned copending application Ser. No. 489,757. The bottom bushing 42 also will serve to guide the spud during installation. As seen in FIGS. 3, 8 and 9, the bottom bushing 42 includes the top annular flange 41 at the top of a ring 90 and a bottom annular flange 91 at the bottom of the ring 90. The top and bottom annular flanges 41 and 91 extend radially outwardly of the ring 90 and are spaced apart by about the thickness of the bottom wall 19 for anchoring of the bottom bushing in the bottom wall as illustrated. The bottom bushing further has a plurality of radially inwardly extending bushing teeth 92 which essentially have the same configuration as the teeth 51 of the upper bushing 48. As with the upper bushing, a small clearance may be provided between the front faces of the teeth and the outer diameter of the spud 32 for facilitating insertion and removal of the spud as well as limited radial movement of the spud in the bushing when the spud is placed under load.

Once the spud 32 is installed, the upper and lower bushings 48 and 42 will serve to laterally restrain the spud in the top and bottom walls 18 and 19 of the substructure 15 for transmission of lateral loads therebetween at respective vertically spaced apart fulcrum or restraining points once the relatively small lateral clearance between the spud and the bushings has been taken up by lateral deflection/bending of the spuds or lateral shifting of the substructure. The bushings also will permit relative vertical movement between the spuds and the structure so that the structure can maintain contact with the soil during any consolidation settlements and tilt slightly as necessary to develop resistance to overturning moments without overloading the structure locally at the spud support points.

During the application of global lateral ice loads, the structure 14 will displace until equilibrium is achieved between such loads and the resisting forces from the mobilization of the foundation soil by the mat (base of the substructure) and the spuds 32. The spuds may elastically yield in bending or bowing until such equilibrium is established.

Upon removal of such global lateral ice loads as during the summer season when redeployment of the structure 14 may be effected, complete return of the structure to its originally deployed position will be precluded by the resistance to lateral movement of the structure resulting from the structure to sea floor interface. As a result, there could exist a substantial residual load in a spud 32 which remains elastically bent. That is, the spud would be analogous to a bent spring constrained at one end of a fixed fulcrum point (the bottom bushing 42) by the foundation soils and at its other end by the upper bushing 48. Because of the stored elastic energy, the head of the spud may kick laterally if the upper bushing is removed.

In accordance with the present invention, removal of the upper bushing 48 may be effected in a controlled manner even when under load both quickly and efficiently without harm to the structure or personnel. Initially, the piston-cylinder assemblies 62 are pressurized in their extend mode, as by a hydraulic fluid pressure system diagramatically indicated at 99 in FIG. 5, to relieve the load on the mechanical lock thereby to permit removal of the mechanical lock. After the mechanical lock has been removed, all vertical restraint loads will be supported by the piston-cylinder assemblies. At this point, an estimation of the residual loads in the spuds may be made by monitoring the pressures in the piston-cylinder assemblies. If the load is found to be below some nominal value, then the spuds can be removed without removal of the bushings. It is noted that the pressure in each piston-cylinder assembly should be checked since non-symmetrical residual loads may exist.

If the residual loads warrant the removal of the upper bushing 48, the pressure in the piston-cylinder assemblies 62 may be controllably relieved to permit vertical unseating movement of the laterally loaded upper bushing. To prevent an uncontrolled release due to hydraulic failure, a flow control device may be utilized so that any hydraulic system pressure loss would not release the load in the piston-cylinder assemblies. To initiate the removal of the upper bushing, fluid in the piston-cylinder assemblies is controllably bled as by suitable means in the hydraulic fluid pressure system 99. During this procedure, each piston-cylinder assembly should be monitored to ensure that the bushing remains level as it is being retracted out of the bushing seat 40. This will keep the bushing from being cocked in the bushing seat and possibly jamming against the spud 32.

It will be appreciated that as the bushing 48 is removed, the resultant lateral spacing between the bushing and the bushing seat 40 will permit lateral movement of the spud 32 thereby to release the elastic energy stored in the spud under the control of the piston-cylinder assemblies 62. The bushing will follow the lateral movement of the spud, this being permitted by the pivotal connections of the piston-cylinder assemblies to the bushing and to their respective support arms 66. Once the bushing has been completely retracted as to the height seen in solid lines in FIG. 5, the extraction of the spud can begin. The manner in which the spud may be extracted is discussed in the above mentioned copending U.S. patent application Ser. No. 489,757.

The amount of permitted vertical travel of the bushing 48 upon retraction from the bushing seat 40 is selected so that the maximum residual spud reaction expected to be encountered is fully relieved before the piston-cylinder assemblies 62 have fully retracted. Also, the angle of the bearing seat preferably is designed to limit the vertical restraint service and retraction loads required of the piston-cylinder assemblies. During retraction of the bushing, the bushing will slide on the spud with horizontal and vertical force components. The angle (taper) of the bearing seat can be optimized so that the stored elastic energy in the spud can be controlled by conventional double-acting piston-cylinder assemblies in the range of 150 to 250 tons. The actual angle selected will be a function of the service loads estimated for a particular application. Typically, the bearing seat angles will be between about 20° to about 30°.

Figure 10:
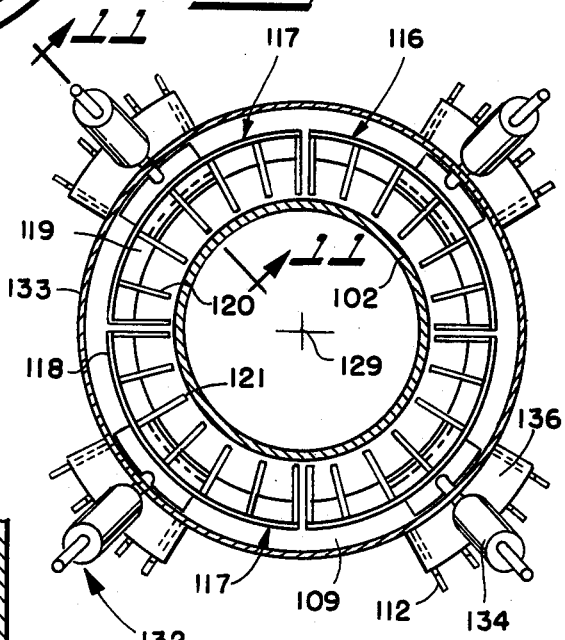
FIG. 10 is a horizontal sectional view through a spud guide showing an alternative upper bushing/seat assembly acording to the invention.
Figure 11:
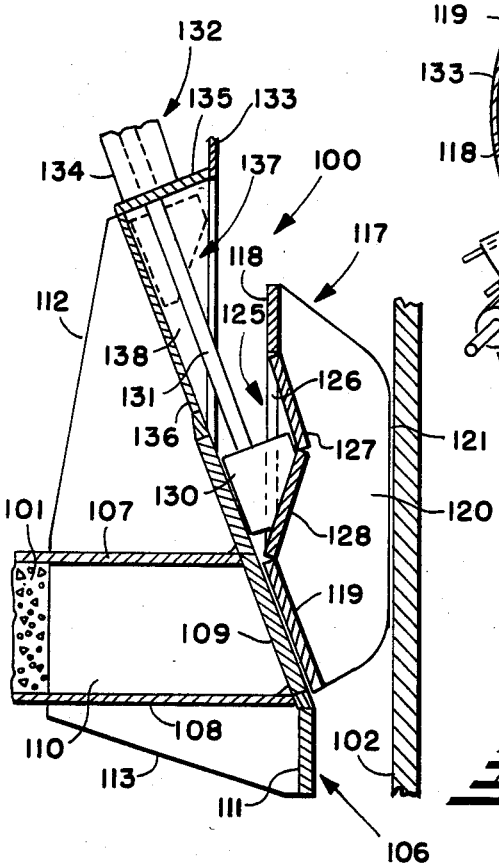
FIG. 11 is an enlarged vertical sectional view through the alternative embodiment of FIG. 10 taken substantially along the line 11—11 thereof.

Turning now to FIGS. 10 and 11, another embodiment of a spud bushing system according to the invention is indicated generally at 100. In relation to the above described mobile platform structure, the bushing system 100 may be used as an alternative to the spud bushing system of FIGS. 1–9 which includes the upper bushing 48, bushing seat 40 and piston-cylinder assemblies 62. Accordingly, the top wall of the substructure can be seen at 101 and a spud at 102 in FIGS. 10 and 11.

The system 100 includes a bushing seat 106 which may be an annular fabricated metal construction including a top horizontal flange palte 107, a bottom horizontal flange plate 108, a conical bearing wall 109, reinforcing plates 110 which radiate outwardly in circumferentially spaced relationship from the bearing wall 109 between the top and bottom flange plates 107 and 108, a cylindrical skirt 111 and top and bottom triangular shape reinforcing gussets 112 and 113. The top and bottom flange plates 107 and 108 (and also the reinforcing plates 110) extend radially outwardly of the bearing wall 109 and are spaced apart by about the thickness of the top wall 101 for anchoring of the bushing seat in the top wall 101 as illustrated. The bearing wall 109 tapers inwardly going from top to bottom and forms a tapered seat for the bushing 116.

The bushing 116 is annualarly segmented into four quadrants or sections 117. Each section 117 may be an arcuate fabricated metal construction including a cylindrical segment upper wall 118 and a conical segment lower wall 119 which tapers radially inwardly from the bottom edge of the upper wall 118 as best seen in FIG. 11. The lower wall 119 corresponds in diameter and taper to the bearing wall 109 in which the bushing sections 117 seat and are lodged against horizontal (radial) movement relative to the top wall 101. Each bushing section 117 further includes a plurality of axially extending or vertical spacer plates or ribs 120 which are circumferentially equally spaced apart and which may extend the full axial length of the bushing section. The spacer plates 120 radiate inwardly from the upper and lower walls 118 and 119 an equal distance and have axially elongated bearing surfaces 121 which collectively serve to support the axially movable spud 102. As seen in FIG. 10, the generally flat bearing surfaces 121 of the bushing sections 117 form a discontinuous cylindrical bearing surface for guiding and laterally supporting the spud when engaged therewith.

For controlled seating and unseating of the bushing 116 with respect to the bushing seat 106, each bushing section 117 includes in its upper wall 118 an annularly centered wedge pocket 125. The wedge pocket 125 is formed at an opening 126 in the upper bushing wall 118 by upper and lower horizontal plates 127 and 128 which are oppositely inclined at the same angle to the center axis 129 of the bushing or spud. The upper plate 127 at its top edge is joined as by welding to the top edge of the opening 126 and at its bottom edge to the top edge of the lower plate 128 which in turn is joined at its bottom edge to the bottom edge of the opening 126. As seen in FIG. 11, the angle of the lower plate 128 to vertical is equal that of the lower wall 119 but in the opposite sense such that the lower plate 128 tapers inwardly going from bottom to top.

The wedge pocket 125 of each bushing section 117 is sized to receive a respective wedge block 130 secured to the rod 131 of a respective piston-cylinder assembly 132. As seen in FIG. 10, there accordingly are four piston-cylinder assemblies 132 which are mounted around the perimeter of the upper spud sleeve 133 at circumferentially equally spaced apart locations. The cylinder 134 of each piston-cylinder assembly 132 is mounted to an inclined mounting plate 135 joined between the top edge of a bearing wall extension 136 and the top edge of an opening provided in the top spud sleeve 133. As best seen in FIG. 11, the bearing wall extension 136 extending radially outwardly of the top sleeve defines a triangular shape recess 137 preferably closed at each side by a triangular shape plate 138 providing a watertight seal between the interior and exterior of the top sleeve 133. The recess 137 is sized to accommodate therein the wedge block 130 upon retraction of the piston-cylinder assembly 132. When the wedge block 130 is in its retracted broken line position seen in FIG. 11, the wedge block 130 is located exteriorly of the top spud sleeve 133 to provide a clean annulus for removal of the bushing section 117.

As seen in FIG. 11, the piston-cylinder assembly 132 is disposed at the same angle as the tapered bearing wall 109. The piston-cylinder assembly is of double acting type and upon extension, the wedge block 130 will be slidably urged from its broken line position along the bearing wall extension 136 and then along the bearing wall 109 to its solid line position for wedging between the bearing wall 109 and the lower plate 128 of the wedge pocket 125. The wedge block 130 has a radially outer surface parallel to the bearing wall 109 for full surface engagement therewith and a radially inner surface inclined to match the angle to vertical of the lower plate 128 for full surface engagement therewith. As will be appreciated, extension of the piston-cylinder assembly 132 will drive the wedge block 130 downwardly into engagement with the bushing section at the wedge socket 125 which bushing section will then be urged downwardly and radially inwardly until fully seated between the bearing wall 109 and the spud 102.

The bushing sections 117 may be set into place after the spud has been driven downwardly into the seat for foundation and when the wedge blocks are in retracted position. After the bushing sections have been set in place between the bearing wall 109 and the outer diameter of the spud 102, the piston-cylinder assemblies 132 may be extended to seat the wedge blocks in the sockets 125 of the bushing sections to provide the necessary vertical load to keep the bushing sections in place. Each bushing section accordingly seats into the tapered bushing seat which transfers the lateral spud loads to the structure. The angle of the bearing seat should be selected to optimize the hydraulic system components which are used to retain the bushing sections in the bushing seat.

During removal of the spud, the hydraulically operated bushing wedge 130 provides the necessary reaction to residual loads in the spud 102 as the bushing section 117 is withdrawn. The pressure in the piston-cylinder assemblies 132 may be controllably relieved to permit vertical unseating movement of the bushing sections. The residual loads accordingly will unseat the bushing sections as the wedge blocks are retracted into the recesses 137 to provide a clear annulus for removal of the spud up through the top spud sleeve 133.

Although the invention has been shown and described with respect to a preferred and also an alternative embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. In a mobile offshore structure, a spud bushing system for transmission of lateral loads between the structure and a spud penetrated into the sea floor while permitting relative vertical movement between the structure and spud, said system comprising:

a bushing seat fixed in the structure;

a bushing operative when seated in said bushing seat to support laterally the spud while permitting relative vertical movement therebetween; and means interengaged between the structure and said bushing for effecting controlled removal of said bushing from said bushing seat when the spud is laterally loaded against said bushing.

2. A system as set forth in claim 1, wherein said bushing seat has a tapered seating surface for said bushing.

3. A system as set forth in claim 2, wherein said bushing has a radially outer seating surface correspondingly tapered to the seating surface of said bushing seat.

4. A system as set forth in claim 3, wherein said seating surfaces are multi-faceted.

5. A system as set forth in claim 1, wherein said bushing substantially circumscribes the spud when seated in said bushing seat.

6. A system as set forth in claim 5, wherein said bushing has circumferentially spaced, spud engaging teeth projecting radially inwardly from an annular ring portion of said bushing.

7. A system as set forth in claim 6, wherein said bushing seat and bushing have correspondingly tapered seating surfaces.

8. A system as set forth in claim 1, wherein said means for effecting includes plural piston-clinder assemblies arranged about the periphery of said bushing seat.

9. A system as set forth in claim 8, wherein said bushing seat has a tapered seating surface for said bushing and said assemblies extend parallel to the taper of said seating surface.

10. A system as set forth in claim 8, wherein each assembly is connected at one end to said bushing and at its other end to an anchor member rigidly connected to said bushing seat.

11. A system as set forth in claim 8, wherein said bushing and bushing seat have correspondingly tapered seating surfaces.

12. A system as set forth in claim 11, wherein said piston-cylinder assemblies each are connected at one end to the structure and at the other end to said bushing.

13. A system as set forth in claim 11, wherein said piston-cylinder assemblies each are pivotally connected at respective ends to the structure and bushing.

14. A system as set forth in claim 11, wherein said means for effecting further comprises means controllably to bleed fluid from said piston-cylinder assemblies.

15. A system as set forth in claim 8, wherein said bushing includes a wedge pocket, and said means for effecting includes a wedge member and means to drive said wedge member into said wedge pocket to hold said bushing means seated in the bushing seat.

16. A system as set forth in claim 15, wherein said bushing is segmented into arcuate sections, and a wedge member and means to drive the same is provided for each bushing section.

17. A system as set forth in claim 1, wherein said bushing is segmented into arcuate sections, and said means for effecting includes a piston-cylinder assembly for each section.

18. A system as set forth in claim 1, wherein said means for effecting includes means axially to hold said bushing against axial forces exerted thereagainst while permitting controlled withdrawal of said bushing from said seat.

19. A system as set forth in claim 1, wherein the structure includes top and bottom horizontal walls, said bushing seat is anchored in said top wall, and there is provided a further bushing in the bottom wall operative to transmit lateral loads between the spud and bottom wall while permitting relative movement therebetween.

20. A spud bushing system for use in a mobile offshore structure to transmit lateral loads between the structure and a respective spud penetrated into the sea floor while permitting relative vertical movement between the structure and spud, said system comprising:

a bushing seat fixable in the structure;

a bushing operative when seated in said bushing seat to support laterally the spud while permitting relative movement therebetween; and bushing operator means interconnectable between the structure and said bushing for seating and unseating said bushing in said bushing seat.

21. A system as set forth in claim 20, wherein said bushing seat and bushing have correspondingly tapered seating surfaces.

22. A system as set forth in claim 20, wherein said bushing operator means includes means for effecting controlled removal of the bushing from the seat under high lateral loads existing between the bushing and the spud when the latter is elastically loaded along its length.

23. A system as set forth in claim 20, wherein said bushing operator means includes plural piston-cylinder assemblies connectable between the structure and said bushing about the periphery of said bushing seat.

24. A system as set forth in claim 23, including means controllably to bleed fluid from said piston-cylinder assemblies.

* * * * *